US011035553B1

(12) United States Patent
Hsu

(10) Patent No.: US 11,035,553 B1
(45) Date of Patent: Jun. 15, 2021

(54) GROUND INSERT LAMP WITH ADJUSTABLE FOCUS

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/736,938

(22) Filed: Jan. 8, 2020

(51) Int. Cl.

| | |
|---|---|
| ***F21S 8/00*** | (2006.01) |
| ***F21V 14/04*** | (2006.01) |
| ***F21V 7/00*** | (2006.01) |
| ***F21V 21/08*** | (2006.01) |
| ***F21V 19/00*** | (2006.01) |
| ***F21V 21/30*** | (2006.01) |
| *F21Y 115/10* | (2016.01) |

(52) U.S. Cl.
CPC ..... *F21V 14/04* (2013.01); *F21V 7/0025* (2013.01); *F21V 19/003* (2013.01); *F21V 21/0824* (2013.01); *F21V 21/30* (2013.01); *F21Y 2115/10* (2016.08)

(58) Field of Classification Search
CPC ..... F21S 6/005; F21S 41/143; F21V 21/0824; F21V 21/30; F21V 13/045; F21V 14/025; F21V 14/065; F21V 14/06; F21V 14/04; F21V 17/02; F21W 2131/109; F21W 2131/10
See application file for complete search history.

(56) References Cited

U.S. PATENT DOCUMENTS

| | | | | |
|---|---|---|---|---|
| 6,612,720 | B1 * | 9/2003 | Beadle | F21V 17/02 362/287 |
| 7,473,007 | B1 * | 1/2009 | Wang | F21V 14/085 362/187 |
| 2017/0167701 | A1 * | 6/2017 | Erdener | F21V 31/03 |

* cited by examiner

*Primary Examiner* — William J Carter
*Assistant Examiner* — Omar Rojas Cadima
(74) *Attorney, Agent, or Firm* — Alan D. Kamrath; Karin L. Williams; Mayer & Williams PC

(57) ABSTRACT

A ground insert lamp includes a ground insert and a lighting assembly detachably mounted on the ground insert. The lighting assembly includes a lamp body, and a light source module. The lamp body is provided with a fixed portion movably mounted on and rotatable relative to the ground insert. The lamp body includes a primary shell, a regulating shell, and a focus regulating module. The light source module is mounted in the primary shell. The focus regulating module includes a reflective mirror, and a convex mirror. The reflective mirror is mounted on the primary shell. The convex mirror is mounted in the regulating shell. The regulating shell is moved relative to the primary shell, and the convex mirror is moved with the regulating shell.

13 Claims, 7 Drawing Sheets

GROUND INSERT LAMP WITH ADJUSTABLE FOCUS

BACKGROUND OF THE INVENTION

1. Field of the Invention

The present invention relates to an illuminating apparatus and, more particularly, to a ground insert lamp.

2. Description of the Related Art

A conventional ground insert lamp comprises a ground insert and a lighting assembly mounted on the ground insert. The lighting assembly includes a lampshade, a light source, and a support pole. Thus, the ground insert lamp provides an illuminating function. However, the lighting assembly is secured on and cannot be rotated relative to the ground insert, such that the angle and the light output direction of the lighting assembly cannot be adjusted freely. In addition, the conventional ground insert lamp has a fixed light output face, and a fixed focus, that cannot be adjusted according to the practical requirement, thereby limiting the versatility of the conventional ground insert lamp.

BRIEF SUMMARY OF THE INVENTION

The primary objective of the present invention is to provide a ground insert lamp with an adjustable focus and an adjustable angle.

In accordance with the present invention, there is provided a ground insert lamp comprising a ground insert and a lighting assembly detachably mounted on the ground insert. The lighting assembly includes a lamp body, and a light source module mounted on the lamp body. The lamp body has a bottom provided with a fixed portion that is movably mounted on and rotatable relative to the ground insert. The lamp body includes a primary shell, a regulating shell movably mounted on the primary shell, and a focus regulating module mounted between the primary shell and the regulating shell. The light source module is mounted in the primary shell. The focus regulating module includes a reflective mirror, and a convex mirror. The reflective mirror is mounted on the primary shell and located outside of the light source module. The convex mirror is mounted in the regulating shell. The regulating shell is moved relative to the primary shell, and the convex mirror is moved in concert with the regulating shell.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
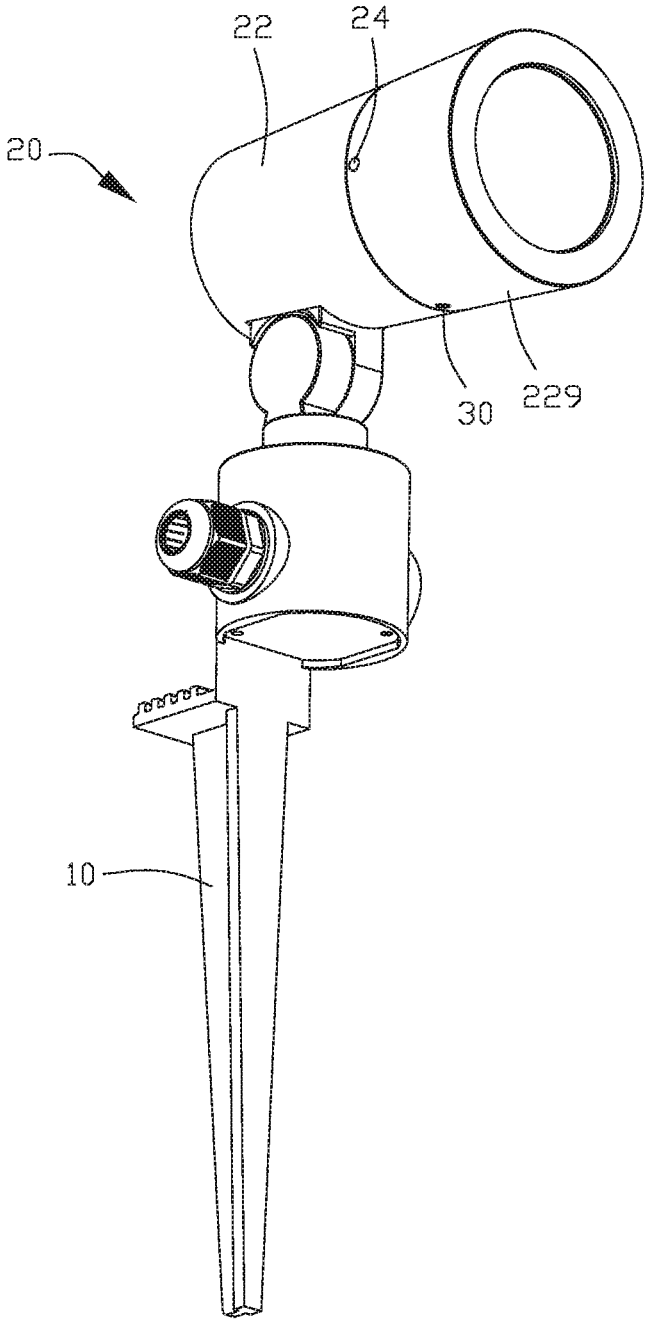
FIG. 1 is a perspective view of a ground insert lamp in accordance with the preferred embodiment of the present invention.
Figure 2:
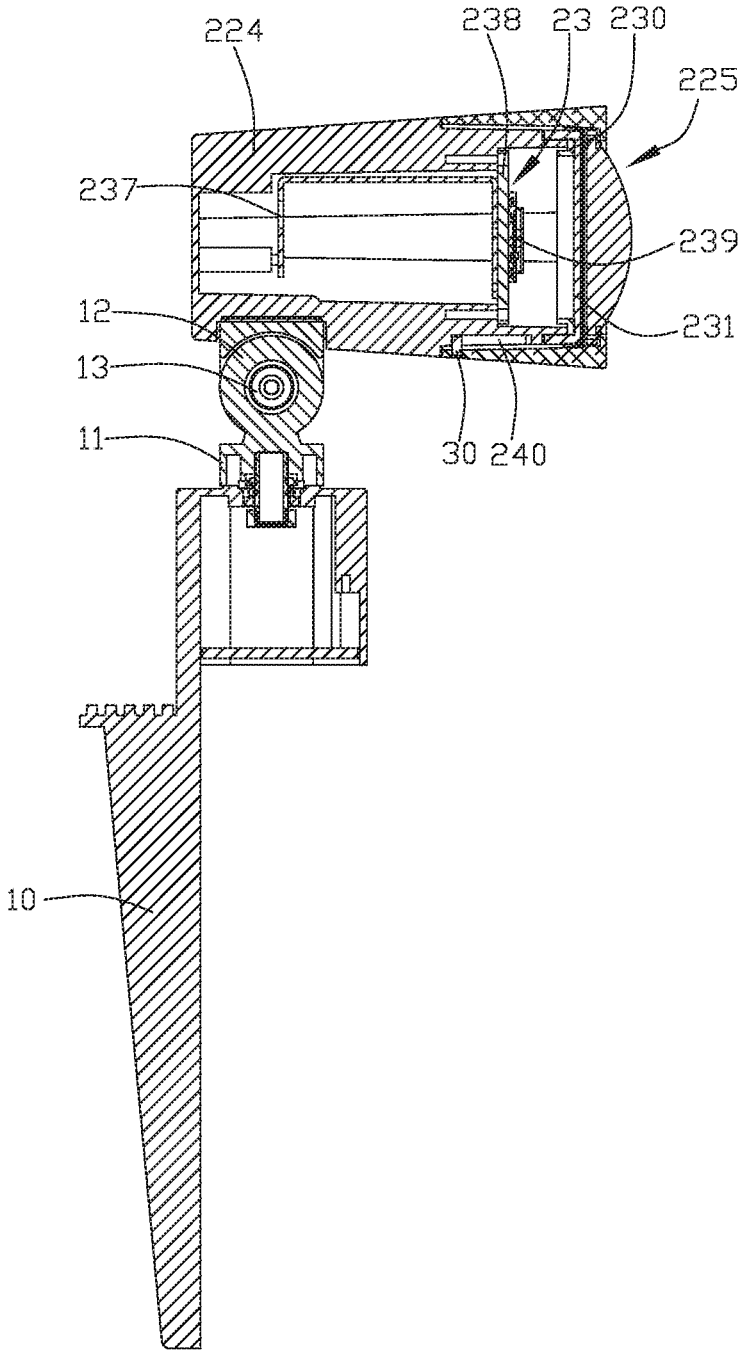
FIG. 2 is a cross-sectional view of the ground insert lamp as shown in FIG. 1.
Figure 3:
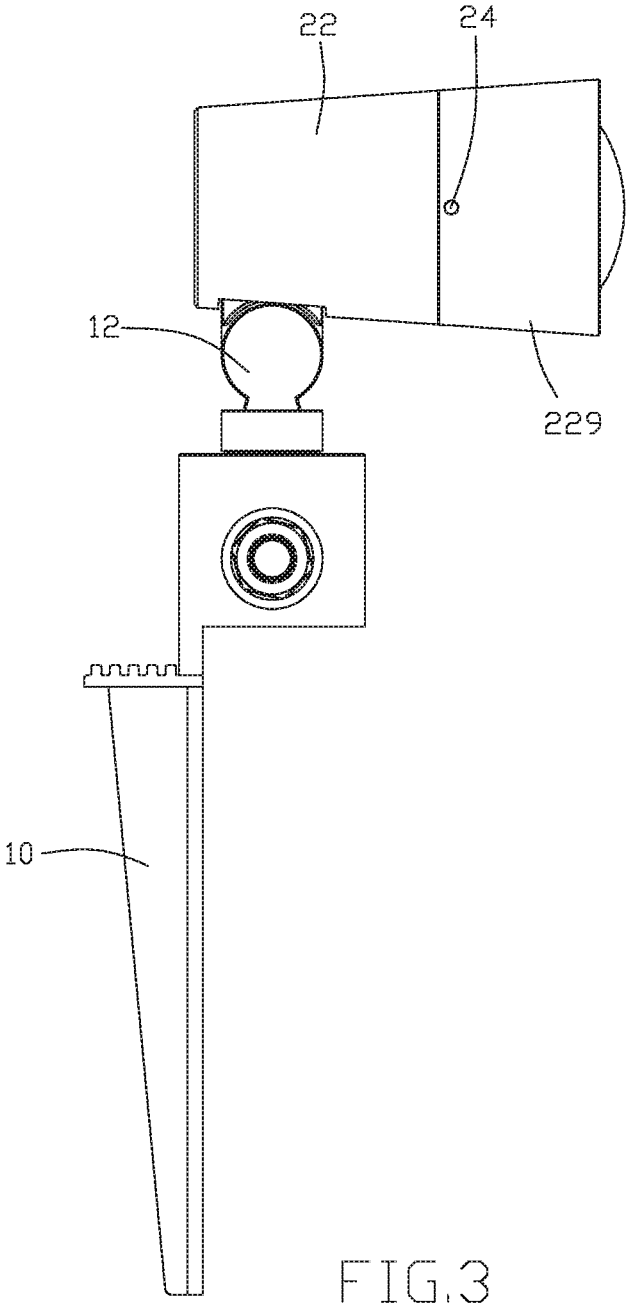
FIG. 3 is a planar view of the ground insert lamp as shown in FIG. 1.
Figure 4:
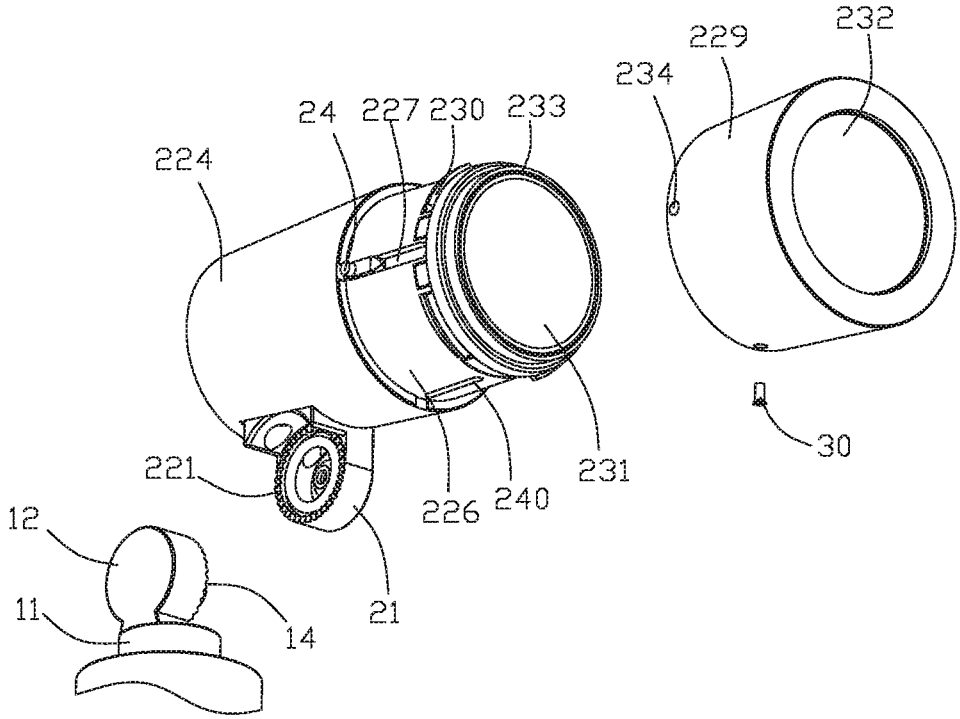
FIG. 4 is a partial exploded perspective view of the ground insert lamp in accordance with the preferred embodiment of the present invention.
Figure 5:
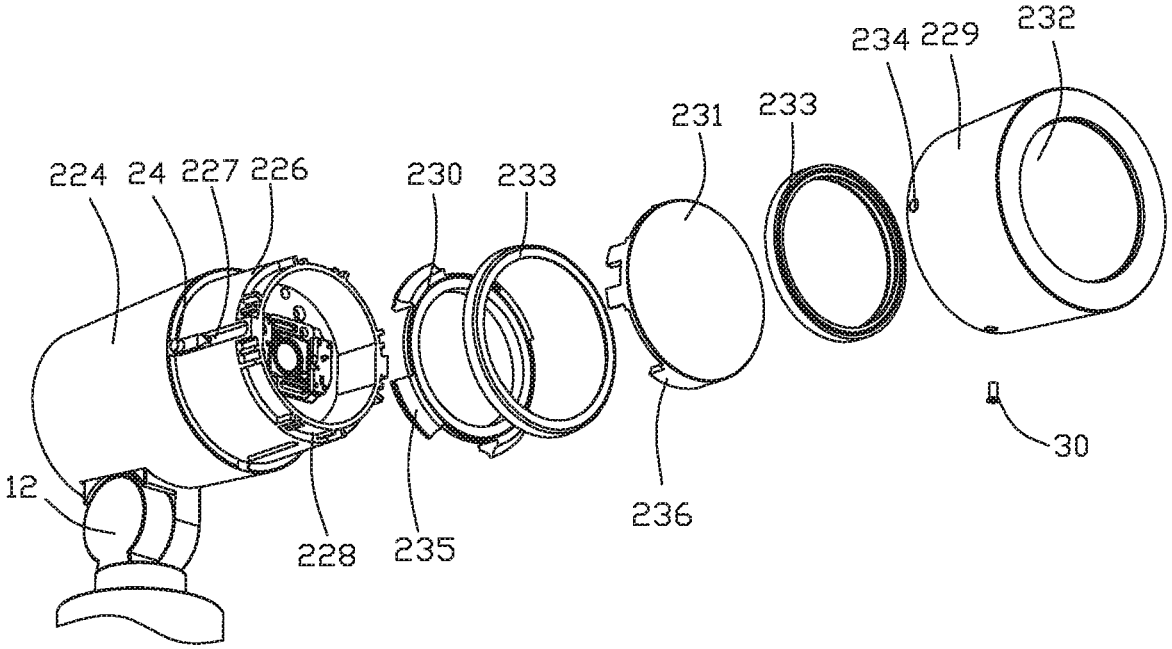
FIG. 5 is another partial exploded perspective view of the ground insert lamp in accordance with the preferred embodiment of the present invention.

Referring to the drawings and initially to FIGS. 1-5, a ground insert lamp in accordance with the preferred embodiment of the present invention comprises a ground insert 10 and a lighting assembly 20 detachably mounted on and rotatable relative to the ground insert 10.

The lighting assembly 20 includes a lamp body 22, and a light source module 23 mounted on the lamp body 22. The lamp body 22 has a bottom provided with a fixed portion 21 that is movably mounted on and rotatable relative to the ground insert 10. The lamp body 22 includes a primary shell 224, a regulating shell 229 movably mounted on the primary shell 224 and movable longitudinally relative to the primary shell 224, and a focus regulating module 225 mounted between the primary shell 224 and the regulating shell 229. The light source module 23 is mounted in the primary shell 224. The regulating shell 229 is located at a front end of the primary shell 224. The focus regulating module 225 includes a reflective mirror (or reflector) 231, and a convex mirror (or lens) 232. The reflective mirror 231 is mounted on the primary shell 224 and located outside of the light source module 23. The convex mirror 232 is mounted in and movable in concert with the regulating shell 229. The regulating shell 229 is moved relative to the primary shell 224, and the convex mirror 232 is moved in concert with the regulating shell 229, to adjust a distance between the convex mirror 232 and the reflective mirror 231, so as to adjust a focus of the convex mirror 232, thereby providing different irradiating angles.

In the preferred embodiment of the present invention, the fixed portion 21 of the lamp body 22 is formed on a bottom of the primary shell 224. The ground insert 10 has a top provided with a mounting portion 12 which has a side provided with a scaled toothed disk 14. The fixed portion 21 of the lamp body 22 has a side provided with an adjusting toothed disk 221 engaging the scaled toothed disk 14 of the ground insert 10. Preferably, the mounting portion 12 is formed on a top of a mounting member 11 which is threadedly connected with the top of the ground insert 10.

In the preferred embodiment of the present invention, the mounting portion 12 of the ground insert 10 is provided with a mounting hole 13. A screw member (or threaded rod) extends through the fixed portion 21 of the lamp body 22 and the mounting hole 13 of the ground insert 10, such that the fixed portion 21 of the lamp body 22 is mounted on the ground insert 10. An adjusting nut is screwed onto the screw member. Thus, the lighting assembly 20 is mounted on the mounting portion 12 of the ground insert 10 by the screw member, and is arranged between the screw member and the mounting member 11 of the ground insert 10. The fixed portion 21 of the lamp body 22 is located between the screw member and the mounting portion 12 of the ground insert 10. In such a manner, the screw member and the mounting member 11 of the ground insert 10 are used to mount and position the lighting assembly 20. In addition, the lighting assembly 20 is driven and rotated by the screw member to rotate relative to the ground insert 10.

In the preferred embodiment of the present invention, the bottom of the lamp body 22 is provided with a mounting recess, and the fixed portion 21 is mounted in the mounting recess.

In the preferred embodiment of the present invention, the primary shell 224 is provided with a regulating portion 226 which has an outer surface provided with two regulating slots 227 which extend longitudinally and are arranged symmetrically. The regulating shell 229 is movably mounted on the regulating portion 226 of the primary shell 224 and is moved relative to the primary shell 224 along the two regulating slots 227. The lighting assembly 20 further includes two movable adjusting members 24 mounted on the lamp body 22. The two movable adjusting members 24 are mounted in the two regulating slots 227 of the primary shell 224, and are moved forward and backward in the two regulating slots 227 of the primary shell 224. The two movable adjusting members 24 are secured to the regulating shell 229 and are moved in concert with the regulating shell 229. The regulating shell 229 is provided with two adjusting holes 234. Each of the two movable adjusting members 24 includes a base movably mounted in one of the two regulating slots 227 of the primary shell 224, and a positioning knob mounted on the base and extending into one of the two adjusting holes 234 of the regulating shell 229. The base 31 of each of the two movable adjusting members 24 is preferably a substantially V-shaped elastic plate.

In the preferred embodiment of the present invention, the focus regulating module 225 further includes a mounting ring 230 mounted on the primary shell 224. The reflective mirror 231 is mounted on and supported by the mounting ring 230. The focus regulating module 225 further includes two O-rings 233. One of the two O-rings 233 is located between the mounting ring 230 and the reflective mirror 231, and the other one of the two O-rings 233 is located between the reflective mirror 231 and the convex mirror 232. The reflective mirror 231 is arranged between the mounting ring 230 and the convex mirror 232.

In the preferred embodiment of the present invention, the regulating shell 229 is provided with a positioning hole (or screw hole). The primary shell 224 is provided with an elongated positioning channel 240. Preferably, the elongated positioning channel 240 of the primary shell 224 extends in a direction and has a length the same as that of the two regulating slots 227. A positioning screw 30 extends through the positioning hole of the regulating shell 229 into the elongated positioning channel 240 of the primary shell 224, and presses a wall of the elongated positioning channel 240, to position the regulating shell 229 on the primary shell 224.

In the preferred embodiment of the present invention, the light source module 23 includes a mounting bracket 237 secured in the primary shell 224, a circuit board 238 mounted on the mounting bracket 237, and an LED light source 239 mounted on the circuit board 231. The LED light source 239 corresponds to the convex mirror 232 of the focus regulating module 225.

In the preferred embodiment of the present invention, the primary shell 224 is provided with a plurality of locking grooves 228. The mounting ring 230 is provided with a plurality of locking blocks 235 locked in the locking grooves 228 of the primary shell 224 respectively. The reflective mirror 231 is provided with a plurality of locking pieces 236 locked in the locking grooves 228 of the primary shell 224 respectively and located between the locking blocks 235 of the mounting ring 230 respectively.

In the preferred embodiment of the present invention, the regulating shell 229 is provided with a limit flange to limit the convex mirror 232.

Figure 6:
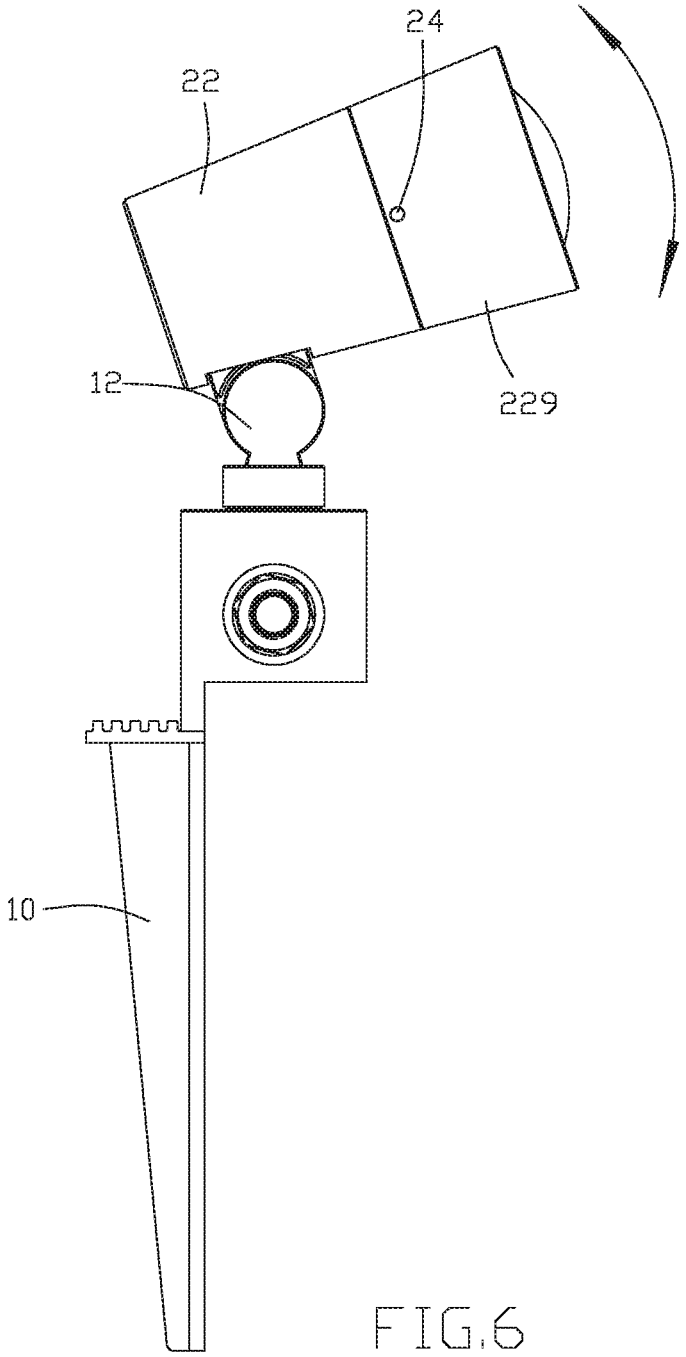
FIG. 6 is a schematic operational view of the ground insert lamp as shown in FIG. 3 in adjustment.

In operation, referring to FIG. 6 with reference to FIGS. 1-5, the adjusting nut is unscrewed from the screw member, to disengage the adjusting toothed disk 221 of the lamp body 22 from the scaled toothed disk 14 of the ground insert 10, such that the fixed portion 21 of the lamp body 22 is rotatable relative to the mounting portion 12 of the ground insert 10, and the lighting assembly 20 is driven to rotate relative to the ground insert 10 through a required angle. Thus, the lighting assembly 20 is rotated relative to the ground insert 10 as shown in FIG. 6, to adjust the angle of the lighting assembly 20 freely. After an angle adjustment of the lighting assembly 20 is finished, the adjusting nut is screwed to tighten the screw member, so as to engage the adjusting toothed disk 221 of the lamp body 22 with the scaled toothed disk 14 of the ground insert 10, such that the fixed portion 21 of the lamp body 22 is secured to the mounting portion 12 of the ground insert 10, and the lighting assembly 20 cannot be rotated relative to the ground insert 10 anymore.

Figure 7:
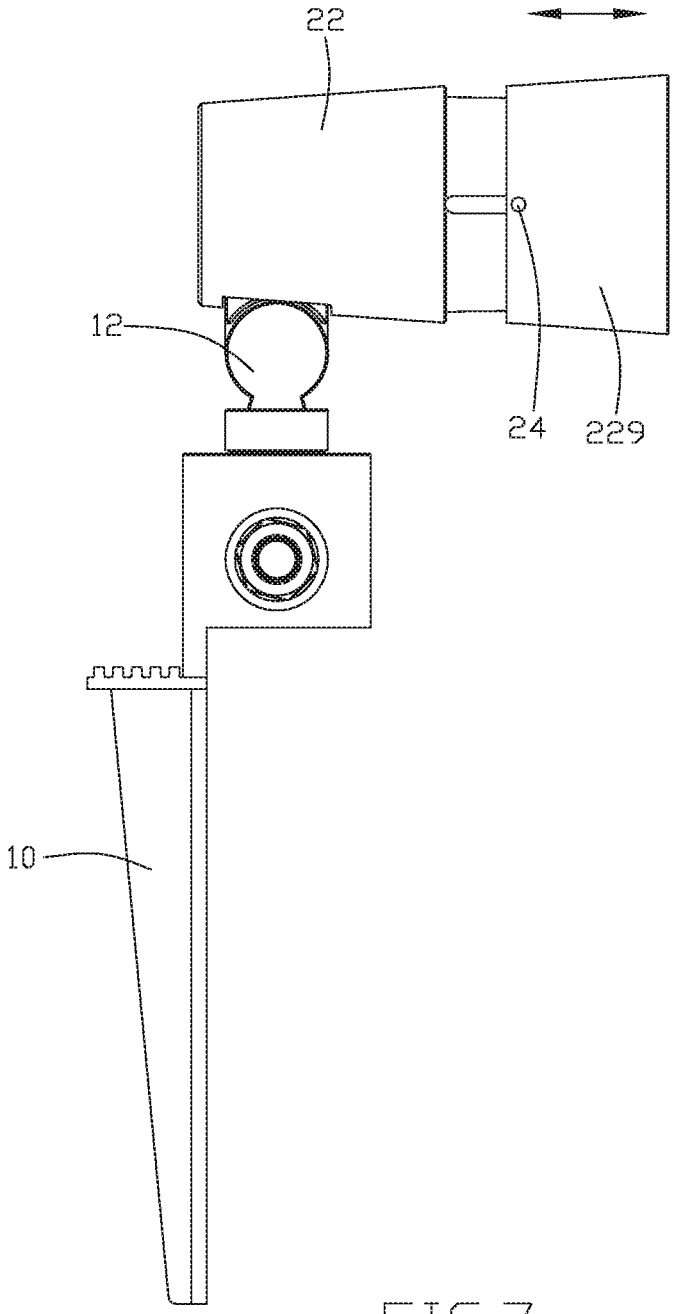
FIG. 7 is a schematic operational view of the ground insert lamp as shown in FIG. 3 in adjustment.

Referring to FIG. 7 with reference to FIGS. 1-5, the positioning screw 30 is unscrewed from the positioning hole of the regulating shell 229, and is detached from the wall of the elongated positioning channel 240, to unlock the regulating shell 229 from the primary shell 224, such that the regulating shell 229 is moved freely. In such a manner, the regulating shell 229 is moved relative to the primary shell 224 by guidance of the two movable adjusting members 24 which are moved in the two regulating slots 227 of the primary shell 224. Thus, the regulating shell 229 is moved relative to the primary shell 224 as shown in FIG. 7, and the convex mirror 232 is moved relative to the reflective mirror 231, to change the distance between the convex mirror 232 and the reflective mirror 231, so as to achieve the purpose of focus adjustment. After is focus adjustment is finished, the positioning screw 30 is screwed into the positioning hole of the regulating shell 229, and pressed the wall of the elongated positioning channel 240, to lock the regulating shell 229 onto the primary shell 224, such that the regulating shell 229 is locked and cannot be moved anymore.

Accordingly, the lighting assembly 20 is rotated relative to the ground insert 10, to adjust the angle of the lighting assembly 20 freely, such that the lighting assembly 20 has different irradiating angles. In addition, the regulating shell 229 is moved relative to the primary shell 224, such that the convex mirror 232 is moved relative to the reflective mirror 231, to change the distance between the convex mirror 232 and the reflective mirror 231, so as to achieve the purpose of focus adjustment. Further, the ground insert lamp has functions of angle adjustment and focus adjustment, thereby enhancing the versatility thereof.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ground insert lamp comprising:

a ground insert; and a lighting assembly detachably mounted on the ground insert;

wherein:

the lighting assembly includes a lamp body, and a light source module mounted on the lamp body;

the lamp body has a bottom provided with a fixed portion that is movably mounted on and rotatable relative to the ground insert;

the lamp body includes a primary shell, a regulating shell movably mounted on the primary shell, and a focus regulating module mounted between the primary shell and the regulating shell;

the light source module is mounted in the primary shell;

the focus regulating module includes a reflective lens, and a convex lens;

the reflective lens is mounted on the primary shell and located outside of the light source module;

the convex lens is mounted in and secured to the regulating shell;

the regulating shell is moved longitudinally relative to the primary shell;

the convex lens is directly driven by and moved in concert with the regulating shell;

the primary shell is provided with a reduced regulating portion which has an outer surface provided with two regulating slots;

the regulating portion is secured to the primary shell;

the regulating shell is movably mounted on the regulating portion of the primary shell and is moved longitudinally relative to the regulating portion of the primary shell along the two regulating slots;

the lighting assembly further includes two movable adjusting members mounted on the lamp body;

the two movable adjusting members are mounted and moved longitudinally in the two regulating slots of the primary shell;

the two movable adjusting members are secured to and directly driven by the regulating shell;

the regulating shell is provided with two adjusting holes;

each of the two movable adjusting members includes a base movably mounted in one of the two regulating slots of the primary shell, and a positioning knob mounted on the base and extending into one of the two adjusting holes of the regulating shell;

the focus regulating module further includes a mounting ring mounted on and secured to the primary shell;

the reflective lens is mounted on and secured to the mounting ring;

the focus regulating module further includes two O-rings;

one of the two O-rings is located between the mounting ring and the reflective lens; and the other one of the two O-rings is located between the reflective lens and the convex lens.

2. The ground insert lamp of claim 1, wherein:

the fixed portion of the lamp body is formed on and secured to a bottom of the primary shell;

the ground insert has a top provided with a mounting portion which has a side provided with a scaled toothed disk; and the fixed portion of the lamp body has a side provided with an adjusting toothed disk engaging the scaled toothed disk of the ground insert.

3. The ground insert lamp of claim 2, wherein the mounting portion of the ground insert is provided with a mounting hole, a screw member extends through the fixed portion of the lamp body and the mounting hole of the ground insert, and an adjusting nut is screwed onto the screw member.

4. The ground insert lamp of claim 1, wherein the bottom of the lamp body is provided with a mounting recess, and the fixed portion is mounted in the mounting recess.

5. The ground insert lamp of claim 1, wherein:

the light source module includes a mounting bracket secured in the primary shell, a circuit board mounted on the mounting bracket, and an LED light source mounted on the circuit board; and the LED light source corresponds to the reflective lens and the convex lens of the focus regulating module.

6. The ground insert lamp of claim 1, wherein the reflective lens is arranged between the primary shell and the convex lens.

7. The ground insert lamp of claim 1, wherein the reflective lens is secured to the primary shell and is disposed at a fixed state.

8. The ground insert lamp of claim 1, wherein the convex lens is movable longitudinally relative to the reflective lens.

9. The ground insert lamp of claim 1, wherein the reflective lens is arranged between the mounting ring and the convex lens.

10. The ground insert lamp of claim 1, wherein the regulating shell is non-rotatable relative to the primary shell.

11. The ground insert lamp of claim 1, wherein the two movable adjusting members are driven by the regulating shell and moved longitudinally relative to the primary shell.

12. A ground insert lamp comprising:

a ground insert; and a lighting assembly detachably mounted on the ground insert;

wherein:

the lighting assembly includes a lamp body, and a light source module mounted on the lamp body;

the lamp body has a bottom provided with a fixed portion that is movably mounted on and rotatable relative to the ground insert;

the lamp body includes a primary shell, a regulating shell movably mounted on the primary shell, and a focus regulating module mounted between the primary shell and the regulating shell;

the light source module is mounted in the primary shell;

the focus regulating module includes a reflective lens, and a convex lens;

the reflective lens is mounted on the primary shell and located outside of the light source module;

the convex lens is mounted in and secured to the regulating shell;

the regulating shell is moved longitudinally relative to the primary shell;

the convex lens is directly driven by and moved in concert with the regulating shell;

the primary shell is provided with a reduced regulating portion which has an outer surface provided with two regulating slots;

the regulating portion is secured to the primary shell;

the regulating shell is movably mounted on the regulating portion of the primary shell and is moved longitudinally relative to the regulating portion of the primary shell along the two regulating slots;

the lighting assembly further includes two movable adjusting members mounted on the lamp body;

the two movable adjusting members are mounted and moved longitudinally in the two regulating slots of the primary shell;

the two movable adjusting members are secured to and directly driven by the regulating shell;

the regulating shell is provided with two adjusting holes;

each of the two movable adjusting members includes a base movably mounted in one of the two regulating slots of the primary shell, and a positioning knob mounted on the base and extending into one of the two adjusting holes of the regulating shell;

the regulating shell is provided with a positioning hole;

the primary shell is provided with an elongated positioning channel; and a positioning screw extends through the positioning hole of the regulating shell and the elongated positioning channel of the primary shell, and presses a wall of the elongated positioning channel.

13. The ground insert lamp of claim 12, wherein the elongated positioning channel extends longitudinally in the primary shell, and the positioning screw is movable longitudinally in the elongated positioning channel of the primary shell.

* * * * *